United States Patent [19]

Lee

[11] Patent Number: 4,840,223

[45] Date of Patent: Jun. 20, 1989

[54] POWER BACK SCRUBBING AND FLUSHING SYSTEM FOR COOLING SYSTEMS

[75] Inventor: Edward Lee, Winnipeg, Canada

[73] Assignee: Solv-X Inventions Ltd., Manitoba, Canada

[21] Appl. No.: 115,434

[22] Filed: Oct. 30, 1987

[51] Int. Cl.[4] ..... F28G 9/00

[52] U.S. Cl. ..... 165/95; 134/169 A; 134/111

[58] Field of Search ..... 165/95; 210/167, 171, 210/172; 123/41.14; 134/169 A, 111

[56] References Cited

U.S. PATENT DOCUMENTS

| | | | |
|---|---|---|---|
| Re. 31,274 | 6/1983 | Babish et al. | 165/95 |
| 2,029,232 | 1/1936 | Green | 251/104 |
| 2,187,413 | 1/1940 | Boezi et al. | 141/1 |
| 2,632,719 | 3/1953 | Tankersley | 165/95 X |
| 3,094,131 | 6/1963 | Williams | 134/98 |
| 3,350,223 | 10/1967 | Monteath | 134/22 |
| 3,409,218 | 11/1968 | Moyer | 237/12.3 |
| 3,431,145 | 3/1969 | Riley | 134/22 |
| 4,054,150 | 10/1977 | Thomas | 134/169 A |
| 4,127,160 | 11/1978 | Joffe | 165/1 |
| 4,176,708 | 12/1979 | Joffe | 165/95 |
| 4,276,914 | 7/1981 | Albertson | 141/92 |
| 4,390,049 | 6/1983 | Albertson | 141/92 |

*Primary Examiner*—Samuel Scott
*Assistant Examiner*—Allen J. Flanigan
*Attorney, Agent, or Firm*—Ciotti & Murashige, Irell & Manella

[57] ABSTRACT

Conventionally, cooling systems are drained and flushed out with a gravity flow of water added through the radiator cup. The present device permits power back scrubbing and flushing through the heater core, through the engine and then through the radiator core thus removing far more scale, rust and sludge than the usual system. It can incorporate a pressure test and then can add the correct amount of antifreeze to the water within the system.

14 Claims, 1 Drawing Sheet

VALVE #38

VALVE #42

POWER BACK SCRUBBING AND FLUSHING SYSTEM FOR COOLING SYSTEMS

BACKGROUND OF THE INVENTION

This invention relates to new and useful improvements in power scrubbing and flushing the coolant system of automobile engines and the like.

These systems normally include an engine block having coolant passages therein, a coolant pump for circulating the coolant, an engine core radiator through which the coolant is passed in order to cool same, and a heater radiator core through which heater coolants may be passed selectively in order to heat the interior of the vehicle.

Even with the additives provided in antifreeze solutions normally available, considerable scale, rust and sludge still occurs and builds up throughout the system and this lowers the efficiency thereof considerably, even to the extent of completely blocking the circulation of the coolant under severe conditions.

Conventionally, radiator chemicals are available to assist in the removal of scale and the like and these are normally poured into the radiator core through the radiator cap.

After running the engine for a predetermined length of time, the system is drained and gravity flushing takes place by inserting a garden hose into the radiator cap and opening the various drain cocks throughout the system.

However it will be appreciated that no scrubbing action can take place under these conditions and this particular system leaves much to be desired particularly when the scale, rust and sludge conditions within the cooling system are severe.

PRIOR ART

The following prior art is known to applicant.

U.S. Pat. No. 2,029,232—F. W. Green, Jan. 28, 1936. This shows a radiator flushing device having a single valve and adapted to be connected to a pressure water system.

U.S. Pat. No. 3,431,145—F. D. Riley, Mar. 4, 1969. This utilizes a method for flushing and cleaning the lubrication system of internal combustion engines by injecting a petroleum derivative solvent with compressed air through the oil filler tube at the same time injecting through the filter opening in the crank case.

U.S. Pat. No. 3,350,223—R. G. Monteath, Oct. 31, 1967. This invention discloses a cleaning method for the liquid circulating system utilizing a mixture of water and air and pressure alternatively through the radiator and engine and out of the engine and through the engine and the radiator and out of the radiator utilizing a plurality of timers and automatic valves.

U.S. Pat. No. 3,409,218—Robert G. Moyer, Nov. 5, 1968. This shows apparatus for cleaning an engine cooling system and for injecting new coolant into the system and includes a distributor with a tank having a rolling diaphragm which divides the interior into an upper coolant reservoir and a lower water chamber.

U.S. Pat. No. 4,127,160—Kenneth L. Joffe, Nov. 28, 1978. This comprises a method and apparatus for flushing debris from a water circulating system of an engine and includes an inlet conduit for flushing liquid together with a series of branch conduits connected to points on the circulation system. A valve or series of valves set above between various positions which dictates different flow paths for the flushing liquid through the conduits and the circulating system.

U.S. Pat. No. 4,390,049—Robert W. Albertson June 28, 1983. This shows a portable operated apparatus for cleaning, flushing and filling the cooling system of an engine. The system is cleaned by sequentially moving liquid in opposite directions through the cooling system utilizing an air operated reciprocating piston pump assembly to agitate or sequentially move the liquid in opposite direction.

The present invention overcomes all of these disadvantages by providing a back flow scrubber and flushing system which is power operated and which can remove the majority of scale, rust and sludge efficiently and rapidly and at the same time can then top-up or replace the necessary quantity of antifreeze at the completion of the cycle. Furthermore, a pressure test of the system can be accomplished readily and easily during the operation of the apparatus.

In accordance with the invention there is provided a system of scrubbing and flushing automotive heater radiators, engine block and engine radiators comprising the steps of routing water under pressure to the outlet side of the heater radiator core, and returning the water after it has passed through the heater radiator core, the engine coolant passages within the engine block and the engine radiator core, routing same back to the outlet side of the heater radiator core and circulating the water for a predetermined time interval, draining the water, connecting a source of water under pressure to the heater radiator core outlet, the heater radiator core, the coolant passages within the engine block and the engine radiator core to a discharge and circulating fresh water through the system for a predetermined length of time.

In accordance with a further aspect of the invention there is provided apparatus for scrubbing and flushing the coolant system of an automobile engine which includes a heater core having an inlet and an outlet, an engine block having coolant passages therein and having inlets and outlets therefore, a coolant pump and an engine radiator core all operatively connected together, said apparatus comprising in combination a fluid pump, a liquid holding reservoir connected to said fluid pump, a first conduit extending from said fluid pump and being operatively connected to the outlet of the heater radiator core, a second conduit connected between the outlets of said coolant passages and said reservoir and a third conduit extending between said reservoir and said first conduit, and first valve means in said second conduit controlling the routing of fluid therethrough.

A still further advantage of the invention is to provide a device which can completely back scrub and flush the entire system, pressure test same and replace the required quantity of antifreeze in the minimum of and at extremely low cost. This means that a radiator flushing liquid and water flushes in a direction counter to the normal coolant flow which lifts off scale and rust formed on the walls of the coolant system during normal operations and normal direction of coolant flow.

A still further aspect of the invention is to provide a device of the character herewithin described which is simple in construction, economical in manufacture and otherwise well suited to the purpose of which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 2:
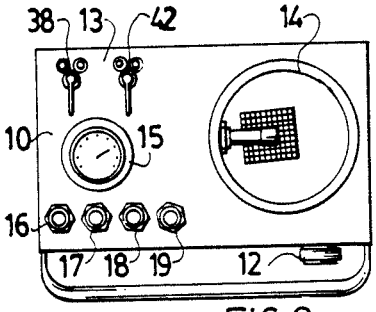
FIG. 2 is a top plane view of the apparatus.
Figure 3:
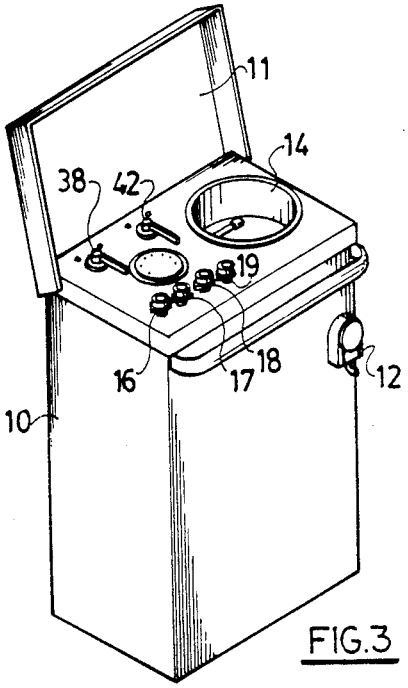
FIG. 3 is an isometric view of the apparatus.

Proceeding therefore to describe the invention in detail, reference should first be made to FIGS. 2 and 3 in which 10 illustrates a casing with a hinged cover 11 on the upper side thereof and a knee operated switch 12 on the front panel.

Not illustrated is a power cord connectable to a source of electrical power such as 110 VAC.

FIG. 2 shows a top plan view of the casing which includes a planar surface 13 and a cylindrical pot or reservoir 14 sunk into the top surface and supported thereby.

A pressure gauge 15 is illustrated in the top panel together with hose connections 16, 17, 18 and 19 all of which are extendable, flexible hoses similar to those used on washing machines, dishwashers and the like.

Hose 16 is adapted to be connected to a conventional water supply under pressure, hose 17 may be extended to a convenient drain, hose 18 is connectable to the heater radiator core inlet conduit 20 and hose 19 is connectable to the hose connection 21 which extends from the top of the engine block 22 to the intake header tank 23 of the engine radiator core assembly collectively designated 24.

Figure 1:
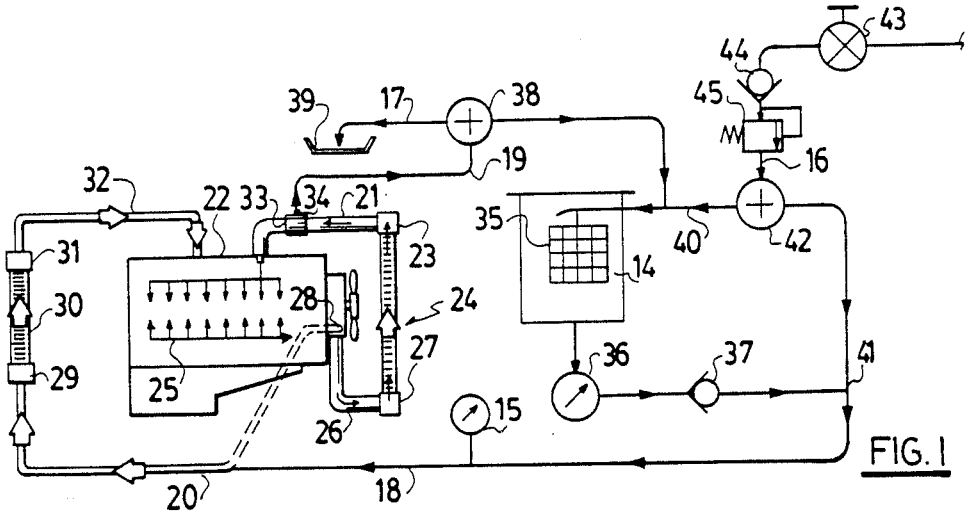
FIG. 1 is a schematic view of the apparatus and system.

These items are also shown in the schematic illustration of FIG. 1 in which the engine block 22 is provided with a plurality of coolant passages illustrated schematically by reference character 25.

These are connected via conduit 21 to the radiator intake header tank 23 and a further conduit 26 extends from the outlet manifold 27 of the radiator to a conventional water or coolant pump 28. From there, a conduit 20 normally extends to the inlet side 29 of a heater radiator core 30 with the inlet 31 of this core being connected by conduits 32, to the coolant passages in the top of the block 22 all of which is conventional.

Before connecting the system to the engine assembly, the conduit 20 is disconnected from the water pump 28 and this normal connection is shown in phantom in FIG. 1.

Furthermore a connector 33 is inserted in series in the hose or conduit 21 having a take-off upper radiator adaptor 34 which is preferrably a garden hose type connection so that the aforementioned conduit 19 from the casing is easily connected to the system.

The other connection is via conduit or hose 18 from the casing 10 which may be connected to the disconnected end of the conduit 20 leading to the heater radiator core 30.

Within the casing is the aforementioned open-topped reservoir 14 which is provided with a filter screen 35 through which all fluid must pass and which connects to a fluid pump and motor assembly shown schematically by reference character 36 and situated within the casing 10.

The outlet of this pump/motor combination is connected to the aforementioned hose 18 which includes a one-way valve 37 therein and also has the pressure gauge 15 connected thereto and which is situated in the top panel 13 of the casing 10.

The hose or conduit 19 which is connected to upper radiator adaptor 34 via the hose connection on the end thereof, leads to a first rotary valve 38 and situated in the top panel 13 of the casing.

The aforementioned drain hose 17 is connected to this valve 38 and may be routed to a convenient drain 39 when in use. The conduit 19 also connects to valve 38 and a third conduit 39 extends from this valve to the return conduit 40 leading to the two conduits 18 as indicated by the junction 41 downstream of the one-way valve 37.

A further rotary valve 42 is situated in conduit 40 between junction 41 and downstream of the connection of conduit 39 with conduit 40.

Water supply under pressure through conduit or hose 16 also connects to valve 42 and this water supply is controlled by a valve 43, a back-flow preventer valve 44 and a pressure reduction regulator 45 all of which are conventional.

Figure 4:
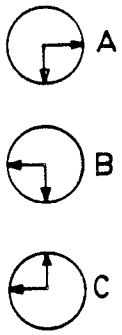
FIG. 4 is a schematic view of the three positions of one of the valves.
Figure 5:
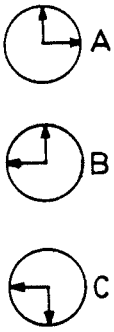
FIG. 5 is a schematic representation of the three positions of the other of the valves.

The valves 38 and 42 are capable of three positions each and these are shown schematically in FIGS. 4 and 5.

Dealing first with valve 38, when in one position, conduit 19 is connected to conduit 39 as indicated by the letter "A" in FIG. 4.

When in the position shown at "B" in FIG. 4, conduit 19 is connected to the drain 17 and when in the position shown in "C" in FIG. 4, this valve closes off all three conduits one from the other.

In FIG. 5, "A" indicates the position of the valve which connects the source of water under pressure via hose 16 to the line 18. When in position "B" in FIG. 5, the water under pressure passes from hose 16 through the valve to the reservoir via line 40 and when in the position shown in "C" in FIG. 5, all three lines are shut off one from the other.

In operation, and dealing first with the power back flush or scrubbing of the chemical scale remover, a conventional corrosive or caustic chemical sold under various names as a radiator flushing liquid may of course be placed within the radiator of the system and the engine run for a predetermined length of time. The heated temperature control inside the car should be turned to the hottest position to ensure flow through the heater radiator core.

The radiator cap is carefully removed and both valves 38 and 42 are placed to the "C" position or the closed position.

The filter basket 35 should be placed within the reservoir ensuring that same is clean and positioned correctly whereupon the device is connected to the source of electrical power through the aforementioned electrical cord (not illustrated). At this point the fluid pump 36 will be "off" as this is controlled by the aforementioned knee switch 12 on the front of the casing.

The water supply line 16 is then connected to a garden hose supply and valve 43 is opened. The adapter 33 is inserted within the hose 21 and line or hose 19 is connected to the upper radiator adaptor 34.

The heater outlet hose 20 is disconnected from water pump 28 and operatively connected to the coolant system supply hose 18. In this connection the open connection left at the water pump should be closed using a short piece of heater hose with a plug and hose clamp.

A short length of garden hose may be connected between the drain hose 17 and the drain 39 and the radiator chemical scale remover is poured into the radiator.

The car engine should be run at idle for some 10 to 15 minutes after which the engine should be switched off.

The back scrubbing or power flushing is undertaken as follows:

Valve 38 should be turned to position "C" i.e. to the off position and valve 42 should be turned to position "B" thus permitting water to flow from the supply to the reservoir 14 which should be filled to approximately half way in order to prime the pump, remove air locks with water and fill the hoses extending from the power scrubber and eliminate any incompletely filled portions of the system. The valve 42 may be turned to position "C" or off.

Valve 38 is then turned to position "A" thus connecting hose 19 with conduit 39 and the fluid pump 36 is actuated by the knee switch 12. This pumps water and chemical from the reservoir 14 along line 18 and into the conduits 20 upwardly through the outlet 29 of the heater radiator core 30 and out through the inlet 31 into hose 32 which leads to the upper side of the engine block 22. It then passes downwardly through all of the coolant passages 25 and out through pump 28 to the conduit 26 and hence to the lower manifold 27 of the engine radiator core. It flows upwardly through the core from the outlet to the inlet header 23 and thence to hose 21 and into line 19, through valve 38 and conduit 39 to conduit 40 and back to the reservoir 14. Straining takes place in basket 35 and this water circulates for approximately 15 to 30 minutes.

The system is then power flushed and the sequence is as follows:

Valve 38 is turned to position "B" thus connecting line 19 to the drain 39 and the reservoir 14 is emptied by pump 36 at which time the fluid pump 36 should be stopped.

Valve 42 is now also turned to position "B" thus connecting the source of water under pressure to line 40 and hence to the reservoir 14. The water should be turned off by valve 42 when the reservoir is approximately half full.

Pump 36 is now started and stopped when the reservoir 14 has been emptied at which time valve 42 should be turned to position "A" and valve 38 to position "B".

Position "A" connects the source of water under pressure to line 18 and position "B" of valve 38 connects line 19 to the drain.

The system is then back flushed with fresh water until it runs clear at the drainline 17 utilizing the pressure of the water system rather than pump 36.

It is advisable to start the car and run same for approximately 5 minutes during the back flush operation to ensure that all of the internal valves are open.

Once water runs clear out of the drain hose 17, valve 38 may be turned to the off position or position "C" thus allowing the mains of water pressure to build up the system pressure to the regulated pressure of approximately 22 PSI at which time valve 42 may be turned to position "C" so that both valves are off and the system is isolated under 22 PSI pressure. The radiator cap normally preset to 15 PSI will reduce the pressure in the system to this 15 PSI.

The pressure test may last for approximately one to five minutes and if no drop occurs then the system would appear to be sound.

At this time the appropriate quantity of antifreeze is added to reservoir 14 depending upon temperature control required and the capacity of the cooling system. At this time valve 38 may be moved to position "B" thus connecting line 19 to the drain and pump 36 may be actuated to pump the antifreeze into the system.

When the reservoir is empty, the pump is closed down, it being understood that the insertion of the required quantity of antifreeze into the system has ejected the equivalent amount of water through line 17 to the drain.

Both valves 38 and 42 are moved to position "C" and the system may be disconnected with the various heater hoses reconnected in the usual way. Upper radiator adaptor 34 may be closed off if it is desired to leave same in circuit with the system.

It will therefore be seen that a relatively simple, efficient power back flush and scrubbing system is provided which is simple in operation and very efficient in use.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for flushing and scrubbing the coolant system of an automobile engine which includes a heater core having an inlet and an outlet, an engine block having coolant passages therein and having inlets and outlets therefore, a coolant pump and an engine radiator core all operatively connected together, said apparatus comprising in combination a fluid pump, a liquid holding reservoir connected to said fluid pump, a first conduit extending from said fluid pump and being operatively connected to the outlet of the heater radiator core, a second conduit connected between the outlets of said coolant passages and said reservoir and a third conduit extending between said reservoir and said first conduit, and first valve means in said second conduit controlling the routing of fluid therethrough.

2. The apparatus according to claim 1 which includes a drain conduit selectively and operatively connected to said first valve means.

3. The apparatus according to claim 1 which includes second valve means connected to said third conduit between said reservoir and the junction of said third conduit to said first conduit and a source of water under pressure operatively connected to said second valve means.

4. The apparatus according to claim 2 which includes second valve means connected to said third conduit between said reservoir and the junction of said third conduit to said first conduit and a source of water under pressure operatively connected to said second valve means.

5. The apparatus according to claim 2 in which said first valve means selectively connects first conduit to said reservoir when in one position, to said drain conduit when in another position and to shut off said conduit when in a third position.

6. The apparatus according to claim 4 in which said first valve means selectively connects first conduit to said reservoir when in one position, to said drain conduit when in another position and to shut off said conduit when in a third position.

7. The apparatus according to claim 3 in which said second valve means selectively connects said source of water under pressure to said reservoir when in one position, to said heater radiator core outlet via said first conduit when in a second position and to a shut-off position when in a third position.

8. The apparatus according to claim 1 which includes a pressure gauge operatively connected in said second conduit between said second valve means and said outlet of said heater radiator core and a check valve situated between said fluid pump and the junction of said second and third conduits.

9. The apparatus according to claim 2 which includes a pressure gauge operatively connected in said second conduit between said second valve means and said outlet of said heater radiator core and a check valve situated between said fluid pump and the junction of said second and third conduits.

10. The apparatus according to claim 3 which includes a pressure gauge operatively connected in said second conduit between said second valve means and said outlet of said heater radiator core and a check valve situated between said fluid pump and the junction of said second and third conduits.

11. The apparatus according to claim 4 which includes a pressure gauge operatively connected in said second conduit between said second valve means and said outlet of said heater radiator core and a check valve situated between said fluid pump and the junction of said second and third conduits.

12. The apparatus according to claim 5 which includes a pressure gauge operatively connected in said second conduit between said second valve means and said outlet of said heater radiator core and a check valve situated between said fluid pump and the junction of said second and third conduits.

13. The apparatus according to claim 6 which includes a pressure gauge operatively connected in said second conduit between said second valve means and said outlet of said heater radiator core and a check valve situated between said fluid pump and the junction of said second and third conduits.

14. The apparatus according to claim 7 which includes a pressure gauge operatively connected in said second conduit between said second valve means and said outlet of said heater radiator core and a check valve situated between said fluid pump and the junction of said second and third conduits.

* * * * *